US008196768B2

(12) United States Patent
Wheaton

(10) Patent No.: US 8,196,768 B2
(45) Date of Patent: Jun. 12, 2012

(54) CONNECTOR, PARTICULARLY FOR CASKS

(75) Inventor: Christopher Simon Courtenay Wheaton, Devon (GB)

(73) Assignee: Cypherco Limited (GB)

( * ) Notice: Subject to any disclaimer, the term of this patent is extended or adjusted under 35 U.S.C. 154(b) by 696 days.

(21) Appl. No.: 12/295,678

(22) PCT Filed: Mar. 29, 2007

(86) PCT No.: PCT/GB2007/001158

§ 371 (c)(1),
(2), (4) Date: Apr. 24, 2009

(87) PCT Pub. No.: WO2007/113500

PCT Pub. Date: Oct. 11, 2007

(65) Prior Publication Data

US 2009/0242518 A1 Oct. 1, 2009

(30) Foreign Application Priority Data

Apr. 1, 2006 (GB) ..... 0606650.0

(51) Int. Cl.
*B65D 51/28* (2006.01)
*B65D 17/42* (2006.01)
*B65D 39/00* (2006.01)

(52) U.S. Cl. ..... 220/277; 220/258.1; 220/258.3; 220/583; 220/592.19; 217/98; 217/110; 217/111; 217/113; 403/6; 403/7; 403/13; 403/278; 403/283

(58) Field of Classification Search ..... 220/254.7, 220/257.1, 258.1, 258.3, 259.2, 277, 583, 220/592.19, 780, DIG. 1; 217/98, 106, 107, 217/110, 111, 113; 29/505; 403/6, 7, 10, 403/13, 274, 278, 283, 345, 348
See application file for complete search history.

(56) References Cited

U.S. PATENT DOCUMENTS

| | | | | |
|---|---|---|---|---|
| 2,009,645 | A | 7/1935 | Trevallon | |
| 2,969,161 | A | 1/1961 | Givens | |
| 5,325,983 | A * | 7/1994 | Imai et al. | 220/277 |
| 5,482,176 | A * | 1/1996 | Maietta et al. | 220/277 |
| 2002/0179605 | A1 * | 12/2002 | Miani et al. | 220/277 |

FOREIGN PATENT DOCUMENTS

| | | |
|---|---|---|
| GB | 2328682 | 3/1999 |

* cited by examiner

*Primary Examiner* — Anthony Stashick
*Assistant Examiner* — Madison L Wright
(74) *Attorney, Agent, or Firm* — Levenfeld Pearlstein, LLC

(57) ABSTRACT

A connector for a container, particularly a cask, comprises a bush (14), intended to be received in an opening (11) in the container through which liquid is discharged, in use. The bush has a closed end (17) with a weakened portion (18), an inner thread (20) and an inner deformable portion (21). Sealing means (23) are intended to be disposed between the exterior of the bush and the interior of the opening at the position of the deformable portion. An insert (15) is screw-threadedly engageable within the bush so as to deform the deformable portion, thereby effecting compression, and thus sealing, of the sealing means between the bush and the container.

16 Claims, 1 Drawing Sheet

CONNECTOR, PARTICULARLY FOR CASKS

Figure 1:
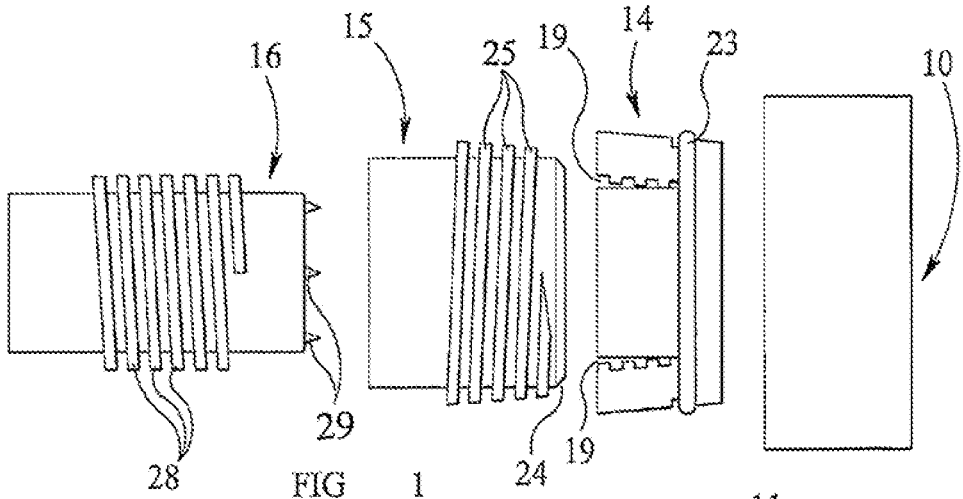

This invention relates to a connector, particularly for casks, and also to a method of fitting such a connector.

In the field of brewing, it is common to refer to draught beer containers of any size as barrels, although this is only strictly correct if the container actually holds 36 gallons (approximately 163.7 litres). The terms 'keg' and 'cask' refer to containers of any size, the distinction being that kegs are used for pasteurised beers intended to be served using external gas cylinders. Real ale and similar beers undergo part of their fermentation process in their containers, which are called casks.

A cask has a large hole at its largest diameter, through which it is filled. It also has a smaller hole, sometimes called a bung-hole, at the lowest point on the cask circumference, through which the product is drawn off from the cask, in use.

Historically the bung-hole has had a solid plug inserted into it at the time the cask is filled at the brewery. The plug is generally a small thick wooden or plastics material disc. When the cask is received at a public house or other point of sale, a tap is hammered through the plug and into the cask.

The centre of the plug may be deliberately weakened. In the plastics variety it is much thinner than the surrounding material; if made of wood it is partially pre-cut so that it is easier to punch out. The tap is fitted to the cask by using a mallet to drive a shaft of the tap through the plug.

Although the shaft of the tap may be tapered to seal against the plug, it is not uncommon for leaks to occur. Changing a leaking plug is relatively time consuming. In view of the manner in which ale is conditioned, upending the cask to bring the plug above the level of the liquid would render the beer undrinkable for at least a day and probably longer, and may have a permanent effect. Thus the plug must be changed in situ.

An object of the invention is to provide an improved connector particularly for a keg, which overcomes the above disadvantage.

According to a first aspect of the invention there is provided a connector for a container, particularly a cask, comprising a bush, intended to be received in an opening in the container through which liquid is discharged, in use, the bush having a closed end with a weakened portion, an inner thread and an inner deformable portion, sealing means intended to be disposed between the exterior of the bush and the interior of said opening at the position of said deformable portion, and an insert screw-threadedly engageable within said bush so as to deform said deformable portion, thereby effecting compression, and thus sealing, of said sealing means between said bush and the container.

Preferably the connector also comprises a further insert which is screw-threadedly engageable within said insert to a position where cutting means of said further insert cut through said weakened portion of the closed end of the bush to provide an opening from the container for liquid to discharge through the further insert.

Accordingly with the bush sealed in the container opening by virtue of the engagement in the bush of the insert, the cask of liquid can be transported to the point of use. Once at said point of use, and when it is required to dispense liquid from the cask, the further insert is screwed into the insert as described above, thereby cutting an opening in the closed end of the bush and allowing liquid to flow from the container through the further insert, to which, immediately prior to said cutting, discharge hoses have been connected at its end opposite that at which said cutting means is disposed.

Desirably the closed end of the bush is defined by a membrane, preferably integral. Conveniently the weakened portion is an annulus, and the weakening allows the centre part of the membrane to be cut out by the cutting means of the further insert. Preferably said further insert is a broach.

The bush can carry an O-ring at its exterior, forming said sealing means. The bush is formed with a number of slots therearound, each extending from the open end of the bush to allow the open perimeter part of the bush to move outwardly to form a taper matching an internal taper of the opening in the container. The inside of the bush has a tapered female thread and desirably the exterior surface of the insert has a tapered male thread to engage said tapered female thread and spread the slotted part of the bush.

Conveniently the interior of the bush adjacent the closed end of the bush has a dilating annulus constituting said deformable portion. When the insert is fully screwed into the bush, its end portion reaches the dilating annulus and pushes the bush wall outwardly ensuring that the external O-ring seal makes sealing contact with the internal side wall of the opening in the container. The insert is preferably a dilator.

Advantageously the interior of the insert is formed with a parallel thread to match the thread on the exterior of the further insert, which, as stated above, is in the form of a broach. The broach is a hollow tube with cutting spikes on its leading end.

According to a further aspect of the invention there is provided a method of fitting a connector to an opening in container, particularly a cask, through liquid is discharged, in use, wherein the connector comprises a bush having a closed end and a weakened portion, an inner thread and an inner deformable portion, sealing means, and an insert screw-threadedly engageable within said bush, the method comprising positioning said bush in said opening with said sealing means disposed around said bush at the position of said inner deformable portion, and threadedly engaging said insert into said bush so that it deforms said inner deformable portion thereby effecting compression, and thus sealing of said sealing means between said bush and the container.

Preferably the method further comprises threadedly engaging into said insert a further insert such that cutting means of said further insert cut through said weakened portion of the bush to provide an opening from the container for discharge of liquid through said further insert.

Figure 2:
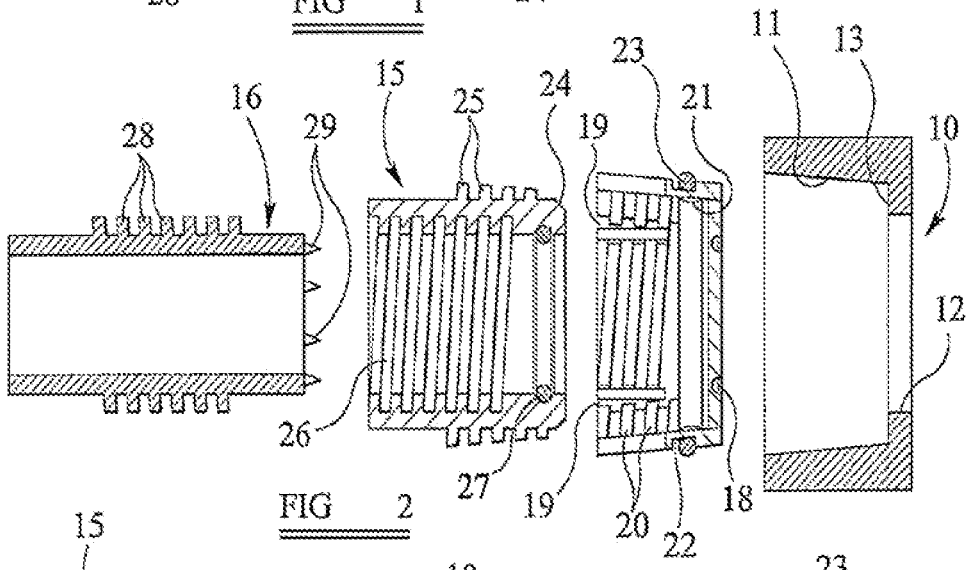
Figure 3:
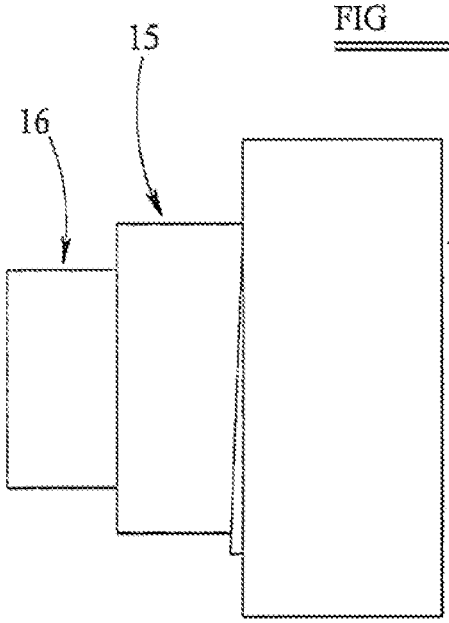
Figure 4:
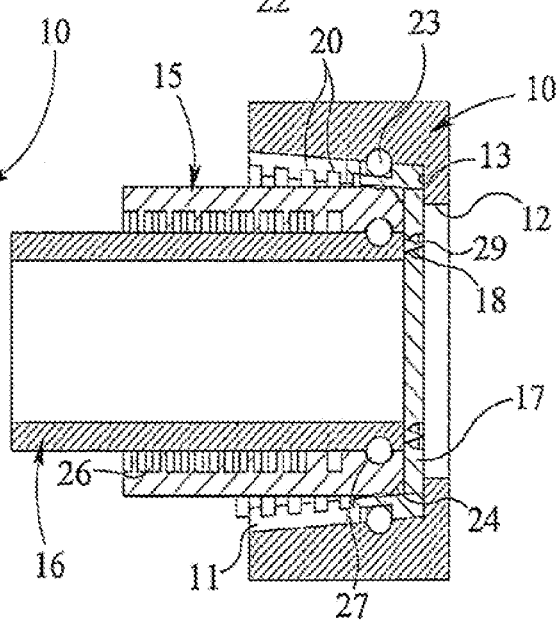

The invention will now be described, by way of example, with reference to the accompanying drawings, in which:

FIG. 1 is an exploded side view of components of the connector of the invention together with a schematic representation of a container port to which the connector is to be fitted, FIG. 2 is a vertical sectional view corresponding to FIG. 1, FIG. 3 is a side view of the components of FIG. 1 fitted in an opening in the container part, and FIG. 4 is a vertical sectional view corresponding to FIG. 3.

FIG. 1 shows a housing 10 which represents part of a container, such as a cask, to which a connector of the present invention is to be fitted. As shown in FIG. 2, the housing 10 is formed internally with a relatively large tapered recess 11 which extends from one end of the housing, from which the recess reduces in diameter, with there being at the other end of the recess a smaller diameter circular section opening 12. It will be seen that there is an annular shoulder surface 13 between the recess 11 and the opening 12. The internal sides of the recess 11 are smooth.

The connector comprises three parts, namely a bush 14, a first insert in the form of a dilator 15, and a second insert in the form of a broach 16.

The bush is of generally hollow cylindrical form, but has its one end closed by an integral membrane 17. However in the outwardly facing surface of the membrane there is formed a concentric annular groove 18 which acts to weaken the membrane to facilitate the cutting of an opening therein as will be described hereinafter. This groove can be of any suitable form, and indeed the weakened portion itself can be provided in various suitable forms. For example instead of a continuous annular groove, the weakened portion could be formed by a series of separated grooves.

Extending inwardly from the end of the bush opposite to that at which the membrane is provided, are slots 19, these being equi-angularly spaced around the bush. These allow the part of the body of the bush in which they are provided to splay outwardly as will be described. The inside of the part of the bush which is slotted is provided with a tapered female thread 20. At the axial position of the bush between the inner ends of the slots 19 and the inner surface of the membrane 17, the interior of the bush is provided with a deformable portion in the form of a dilating annulus 21. The external surface of the bush at this axial position of the dilating annulus 21 is formed with a rectangular annular recess 22 in which is received an O-ring seal 23.

The dilator 15 is in the form of a hollow cylinder having a chamfered leading edge as shown at 24. On its exterior surface, spaced a little way axially rearwardly of the chamfer 24 it is provided with a tapered male thread 25 which mates with the tapered female thread 20 within the bush 14 so that this dilator can be screwed into engagement within the bush. The interior of the dilator is provided with a parallel thread 26 which extends from the end of the dilator remote from its chamfer 24 substantially up to an interior groove adjacent the chamfered end, in which groove is provided an O-ring seal 27.

The broach 16 is in the form of a cylinder having on its exterior surface, centrally between its opposite ends, a parallel thread 28 matching the thread 26 of the dilator 15, so that the broach can be screw-threadedly engaged with said dilator. At its leading end, the broach is provided with cutting means in the form of a multiplicity of forwardly directed cutting spikes 29 which, as will be described, are arranged to penetrate the membrane 17 at the weakened annular groove 18, as shown in FIG. 4.

To fit the connector to the opening in the housing 10, the bush is firstly placed in the tapered recess and the dilator 15 is then screwed into the female thread of the bush 14. The provision of the tapered thread 25 on the dilator means that the bush is dilated or splayed, such that the exterior surface engages against the side of the wall of the tapered recess of the opening in the housing 10. It will be understood that the front part of the bush engages tightly against the shoulder surface 13.

As screwing in of the dilator is continued, the leading end, with the chamfer 24, comes into contact with the dilating annulus 21. The dilator then continues to move forward in the bush, the engagement of the dilator with this dilating annulus 21 causes the wall of the bush at said annulus 21 to be moved outwardly, thereby ensuring that the O-ring 23 comes into tight sealing contact with the inner side wall of the recess 11 in the housing 10, thereby ensuring that the bush is tightly sealed to the housing 10, and thus to the container, i.e. the cask, of which the housing is part. Accordingly with the bush sealed in the container by virtue of the dilator having been screwed in to its full extent, the container (cask) of liquid can then be transported to a point of use.

At such point of use, the broach 16 is inserted into the dilator such that the male threads on the broach engage with the female threads within the dilator and by screwing in the dilator the cutting spikes 29 eventually engage the inner surface of the membrane in the area of the annular groove 18. As the broach is fully screwed in to the dilator, the rotating spikes cut a hole in the annulus by virtue of the spikes penetrating through the membrane at said weakened portion constituted by the groove 18. Immediately prior to penetrating the annular groove 18, one or more discharge hoses are connected to the end of the broach opposite to that at which the spikes 29 are provided, this end forming a hose connector at the discharge end of the broach.

Accordingly when the spikes cut through the weakened portion of the membrane and thereby produce an opening, it is clear that liquid can then flow from the container into the broach 16 and thence along the discharge hose or hoses given that, as shown in FIG. 4 immediately prior to this scenario, the broach is effectively directly connected to the circular opening 12 of the housing 10.

It will thus be appreciated that the connector of the present invention does not require either a plug or a tap having to be hammered into the cask, as with the prior art. It is also believed that the connector would be less prone to leaks than prior art arrangements, and additionally allows easy removal of a bush, if required.

The invention claimed is:

1. A connector for a container, particularly a cask, comprising a bush, received in an opening in the container through which liquid is discharged, in use, the opening having an interior, the bush having an exterior, an interior and a closed end with a weakened portion, an inner thread and an inner deformable portion disposed at a position of the bush, sealing means disposed between the exterior of the bush and the interior of said opening at said position of the bush, and an insert screw-threadedly engageable within said bush so as to deform said deformable portion, thereby effecting compression, and thus sealing, of said sealing means between said bush and the container.

2. A connector according to claim 1, also comprising a further insert which is screw-threadedly engageable within said insert to a position where cutting means of said further insert cut through said weakened portion of the closed end of the bush to provide an opening from the container for liquid to discharge through the further insert.

3. A connector according to claim 2, wherein said further insert is a broach.

4. A connector according to claim 1, wherein the closed end of the bush is defined by a membrane, preferably integral.

5. A connector according to claim 2, wherein the closed end comprises a membrane having a center part and an annulus, the annulus forming the weakened portion, and the weakening allows the center part of the membrane to be cut out by the cutting means of the further insert.

6. A connector according to claim 1 wherein the bush carries an O-ring at its exterior, forming said sealing means.

7. A connector according to claim 1, wherein the bush has an open end defining an open perimeter of the bush, the bush being formed with a number of slots therearound, each extending from said open end to allow the open perimeter part of the bush to move outwardly to form a taper matching an internal taper of the opening in the container.

8. A connector according to claim 7, wherein the bush has an internal tapered female thread and the insert has a tapered male thread on its exterior surface to engage said tapered female thread to spread the slots of the bush.

9. A connector according to claim 1 wherein the interior of the bush adjacent the closed end of the bush has a dilating annulus constituting said deformable portion.

10. A connector according to claim 1, wherein the insert is a dilator.

11. A connector according to claim 3, wherein the insert has an interior formed with a parallel thread to match an exterior thread of the further insert.

12. A connector according to claim 3, wherein the broach is a hollow tube with cutting spikes on its leading end.

13. A connector according to claim 2, wherein the insert has an interior formed with a parallel thread to match an exterior thread of the further insert, wherein the insert is a hollow tube with cutting spikes on its leading end.

14. A method of fitting a connector to an opening in container, particularly a cask, through liquid is discharged, in use, wherein the connector comprises a bush having a closed end and a weakened portion, an inner thread and an inner deformable portion disposed at a position of the bush, sealing means, and an insert screw-threadedly engageable within said bush, the method comprising positioning said bush in said opening with said sealing means disposed around said bush at said position, and threadedly engaging said insert into said bush so that it deforms said inner deformable portion thereby effecting compression, and thus sealing of said sealing means between said bush and the container.

15. A method according to claim 14, further comprising threadedly engaging into said insert a further insert such that cutting means of said further insert cut through said weakened portion of the bush to provide an opening from the container for discharge of liquid through said further insert.

16. A connector for a container, particularly a cask, comprising a bush, received in an opening in the container through which liquid is discharged, in use, the opening having an interior, the bush having an exterior, a closed end with a weakened portion, an inner thread and an inner deformable portion disposed at a position of the bush, sealing means disposed between the exterior of the bush and the interior of said opening at said position, and an insert screw-threadedly engageable within said bush so as to deform said deformable portion, thereby effecting compression, and thus sealing, of said sealing means between said bush and the container, the connector also comprising a further insert which is screw-threadedly engageable within said insert to a position where cutting means of said further insert cut through said weakened portion of the closed end of the bush to provide an opening from the container for liquid to discharge through the further insert and wherein the weakened portion is an annulus, the closed end comprising a membrane having a center part and the weakening allowing the center part of the membrane to be cut out by the cutting means of the further insert.

* * * * *